US007195123B2

(12) United States Patent
Roslof et al.

(10) Patent No.: US 7,195,123 B2
(45) Date of Patent: Mar. 27, 2007

(54) MERCHANDISING SYSTEM

(75) Inventors: James P. Roslof, Elkhorn, WI (US); Allen E. Johnson, Hartford, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 11/505,034

(22) Filed: Aug. 16, 2006

(65) Prior Publication Data

US 2006/0273053 A1 Dec. 7, 2006

Related U.S. Application Data

(63) Continuation of application No. 10/429,207, filed on May 9, 2003, now abandoned.

(60) Provisional application No. 60/379,585, filed on May 10, 2002.

(51) Int. Cl.
*A47F 7/00* (2006.01)

(52) U.S. Cl. ..... 211/59.3

(58) Field of Classification Search ..... 211/59.3, 211/51, 59.2, 126.1, 162, 126.3
See application file for complete search history.

(56) References Cited

U.S. PATENT DOCUMENTS

| | | | |
|---|---|---|---|
| 3,083,067 | A | 3/1963 | Vos et al. |
| 3,110,402 | A | 11/1963 | Mogulescu |
| 5,634,564 | A | 6/1997 | Spamer et al. |
| 6,142,317 | A | 11/2000 | Merl |
| 6,889,855 | B2 | 5/2005 | Nagel |

*Primary Examiner*—Sarah Purol
(74) *Attorney, Agent, or Firm*—Foley & Lardner LLP

(57) ABSTRACT

A merchandising system is disclosed. The merchandising system provides for the presentation and storage of products contained in product cases comprising a base having a front end and a back end, the base being configured to support the products. In addition, the merchandising system comprises an assembly for advancing the products from the back end to the front end, and a frame that engages a successive product unit to be presented for display.

20 Claims, 6 Drawing Sheets

MERCHANDISING SYSTEM

CROSS-REFERENCE TO RELATED PATENT APPLICATIONS

This application is a continuation of prior application Ser. No. 10/429,207, filed May 9, 2003 now abandoned, which claims the benefit of provisional Application No. 60/379,585, filed May 10, 2002, both of which are incorporated herein by reference in their entirety.

BACKGROUND

The present invention relates generally to the field of merchandising systems. In particular, the present invention relates to merchandising systems providing for orderly presentation of product in a display space.

It is known to provide for a merchandising system that may be used for displaying products in consumer settings such as grocery stores, retail outlets, shops, etc. Such known merchandising systems may be used to present, display and store products in fixed or limited spaces such as on shelves, in display cases, cabinets, etc.

It is beneficial when merchandising a product to allow potential customers to view or handle it in a convenient and comfortable manner. Known merchandising systems may display products to a consumer by providing the products in a side-to-side or end-to-end configuration. However, products and product containers come in a variety of sizes and shapes, and some products may be more difficult to merchandise (e.g., present for potential retail sale) than others. Within fixed or limited spaces, known merchandising systems may not be configured to optimize the presentation of such products to a customer. Such known merchandising systems also do not always provide convenient ways for dispensing products, especially those with unique or irregular shapes. Ease of use can be an important concern for customers and store personnel. As is sometimes the case, product or container design may be dictated by considerations separate from the ease or difficulty with which the product may be presented.

Accordingly, it would be advantageous to provide a merchandising system that is configured for stocking, orderly presentation, and convenient storage of products with a shape that may not be easily stored, presented, or displayed, such as products with uniquely shaped containers. It would also be advantageous to provide a merchandising system that is configured for selective modularity in the construction and assembly of the merchandising system. It would also be advantageous to provide a merchandising system that allows for the construction and assembly of a merchandising system with any number of product facings, modules, compartments, etc. It would also be advantageous to provide a merchandising system that advances a product and/or allows a product to advance along a defined path. It would also be advantageous to provide a merchandising system having a frame for supporting and selectively retaining a product within the merchandising system. It would also be advantageous to provide a merchandising system that can accommodate, support and display products that need to be displayed in one orientation but which products do not have a base to support themselves.

It would be advantageous to provide a merchandising system or the like of a type disclosed in the present application that provides any one or more of these or other advantageous features.

SUMMARY

The present invention relates to a merchandising system for presenting and storing products provided in product cases. The merchandising system comprises a base having a front end and a back end, the base being configured to support the products. In addition, the merchandising system includes an assembly for advancing the products from the back end to the front end, and at least one frame for engaging a successive product unit to be presented for display.

The present invention also relates to a merchandising system comprising a support assembly having a front end and a back end, the support assembly being configured to support the products in a substantially vertical orientation. In addition, the merchandising system includes at least one frame member located near the front end of the support assembly for selectively dispensing the products from the merchandising system.

The present invention further relates to a merchandising system for storing and presenting products on a shelf or display case where the products are provided in product cases. The merchandising system comprises a means for supporting the products in a substantially vertical orientation, a means for advancing the products along a predefined path, and a means for selectively distributing the products from the merchandising system.

The present invention also relates to a merchandising system for dispensing products comprising a base, a pusher providing a force on the products, and a frame member having a portal through which the products may be dispensed. The frame member provides a holding force against the force provided by the pusher on the products. One or more of the products may be dispensed through the portal by disengagement from the frame member.

DETAILED DESCRIPTION OF EXEMPLARY EMBODIMENTS

Referring to FIGS. 1 through 9D, various exemplary and alternative embodiments of a merchandising system intended for displaying articles such as products, containers, items, units, etc. in consumer settings such as grocery stores, retail outlets, shops, etc are shown. According to a preferred embodiment, the merchandising system is intended to dispense, store, merchandise, display, etc. articles to provide for the space-efficient presentation of groups of articles within a given or fixed display area, and/or to allow for convenient and orderly presentation, dispensing, and storage of articles (such as products or product containers) having any of a wide variety of sizes, shapes, and profiles (e.g., rectangular, non-rectangular, etc.).

Figure 1:
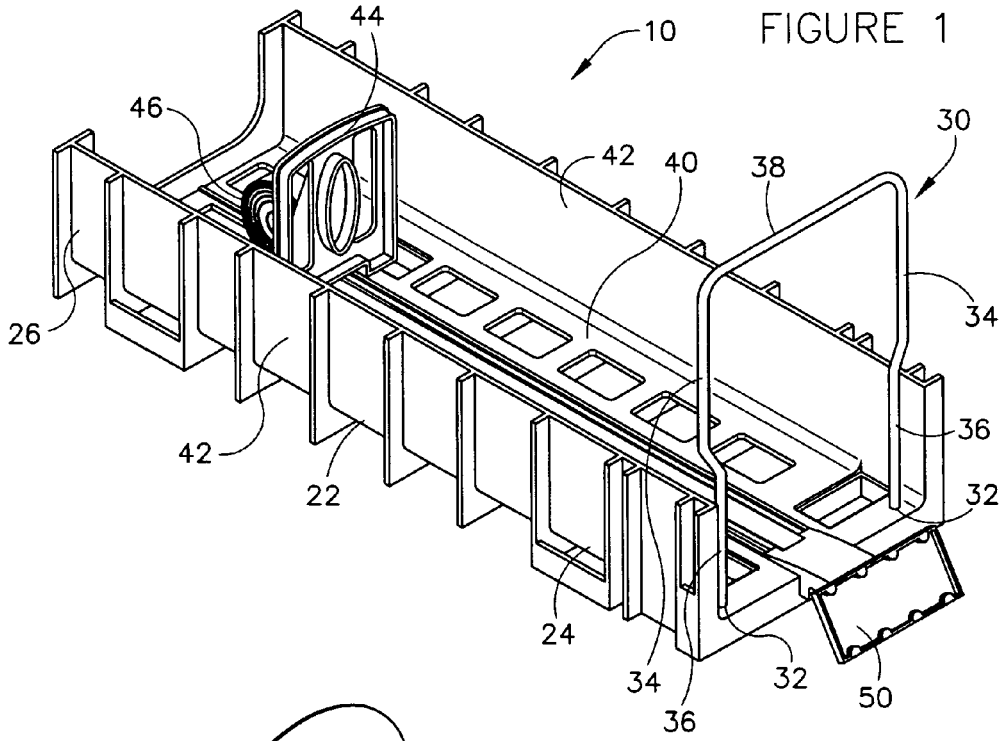
FIG. 1 is a front perspective view of a merchandising system according to an exemplary embodiment.
Figure 2:
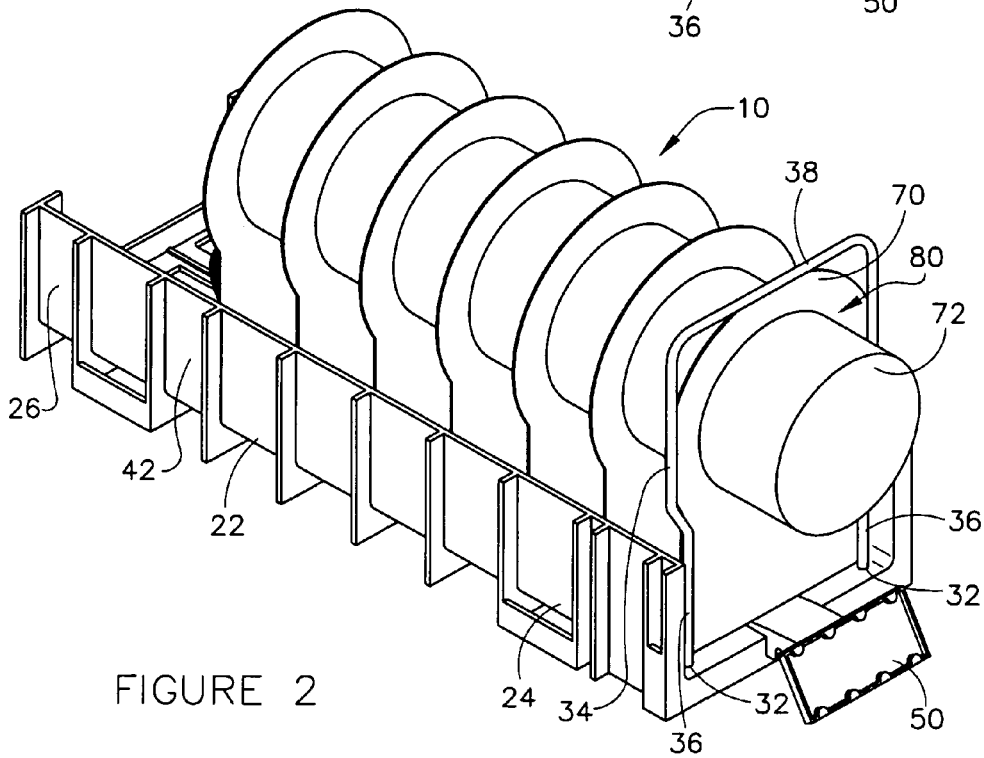
FIG. 2 is a front perspective view of the merchandising system containing product.

FIGS. 1 through 7 show a merchandising system 10 according to an exemplary embodiment. System 10 includes a base 22 (e.g., tray system, support assembly, etc.) having a front end 24 and a back end 26. Base 22 is configured to provide support for articles (shown as product 80 in FIG. 2) positioned within system 10. Merchandising system 10 also includes an assembly 28 for advancing products and/or allowing products to advance from back end 26 to front end 24. System 10 also includes a frame or frame member 30 for receiving products as they advance from back end 26 to front end 24. As shown in FIGS. 1 and 2, frame 30 is configured to receive, support, retain, or otherwise hold in place variously sized articles (shown as packages of lunchmeat in FIG. 2). System 10 is configured to support the products in a substantially vertical orientation.

According to various exemplary embodiments, one or more base (e.g., tray system) may be provided. The base may be provided on an existing merchandising system such as a shelf, grid system, display case, etc. The base may be configured to hold, display, retain, store, or otherwise receive product (e.g., goods, displayed objects, etc.). The base provides for the space division and orderly and convenient presentation of such products.

Figure 7:
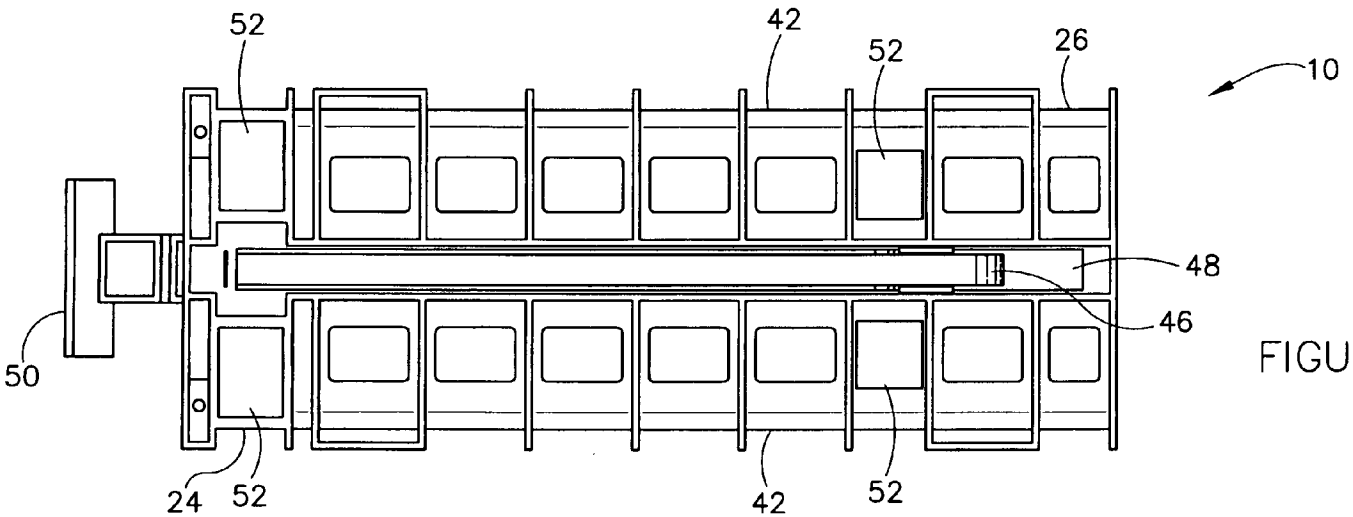
FIG. 7 is a bottom plan view of the merchandising system.
Figure 8:
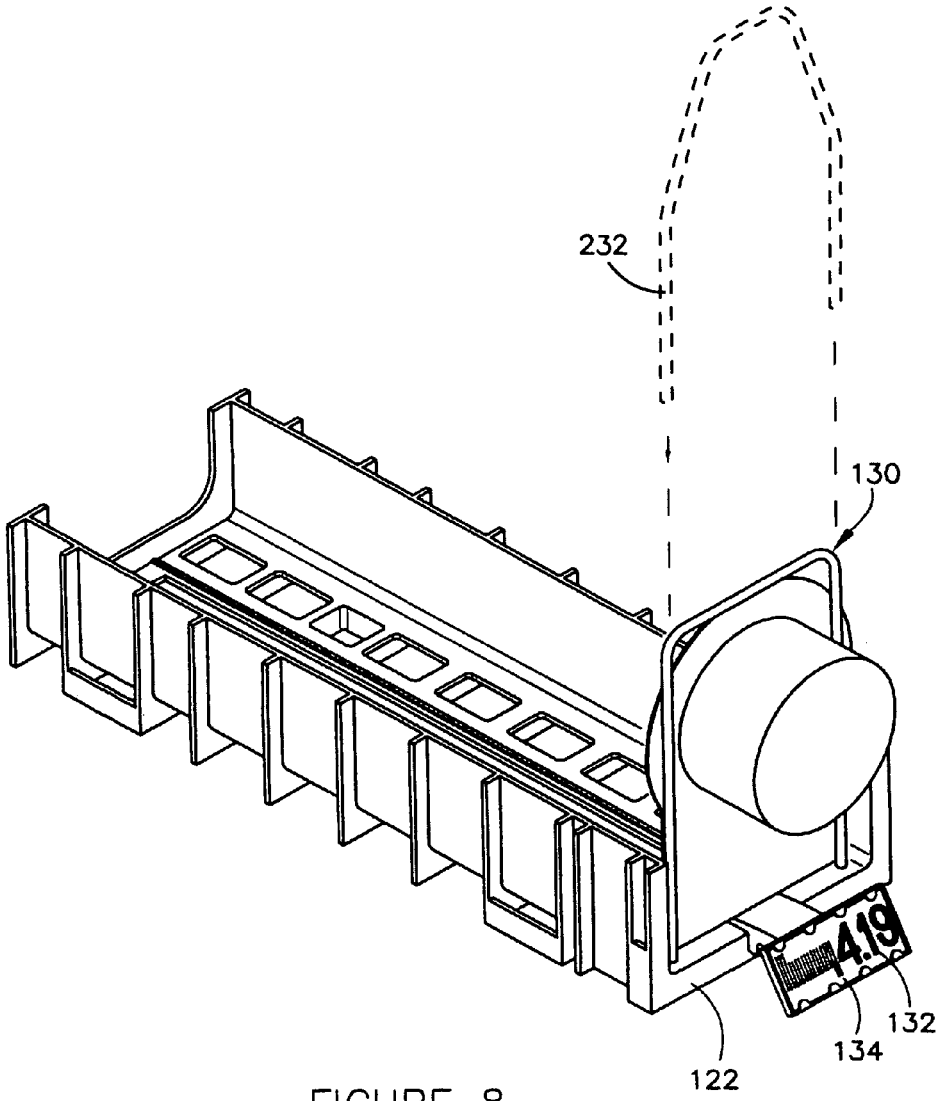
FIG. 8 is a perspective view of a merchandising system containing product according to an exemplary embodiment.
Figure 9A:
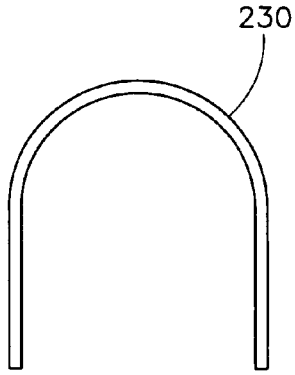
FIGS. 9A through 9D are front plan views of frames for a merchandising system according to alternative embodiments.
Figure 9B:
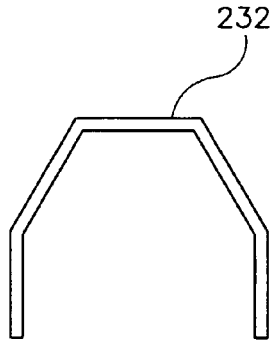
Figure 9C:
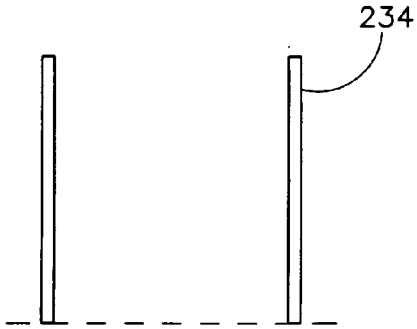
Figure 9D:
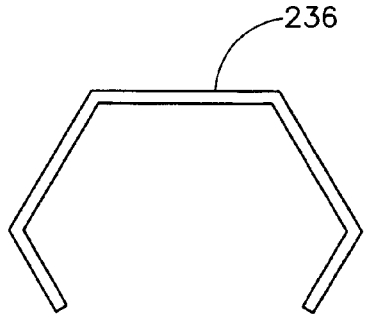

As shown in FIGS. 1 through 7, base 22 comprises two sidewalls 42 (e.g., divider panels, separators, walls, sides, panels, etc.) and a lower surface 40. In addition, base 22 is configured to connect or couple adjacent systems into a larger overall merchandising system. According to a preferred embodiment, the base has a "modular" construction and facilitates use with other bases, shelves, or a variety of other existing merchandising systems, including shelving units, support surfaces, grids, brackets, hangers, etc. According to an alternative embodiment, the base may include a back wall to further add support for product contained within a merchandising system. As shown in FIG. 7, base 22 comprises supports 52 (shown as magnets) that allow for various configurations of system 10. According to alternative embodiments, the supports may include any number of objects that provide for coupling with a mounting surface. For example, the supports may include cushions, adhesives, etc.

Figure 3:
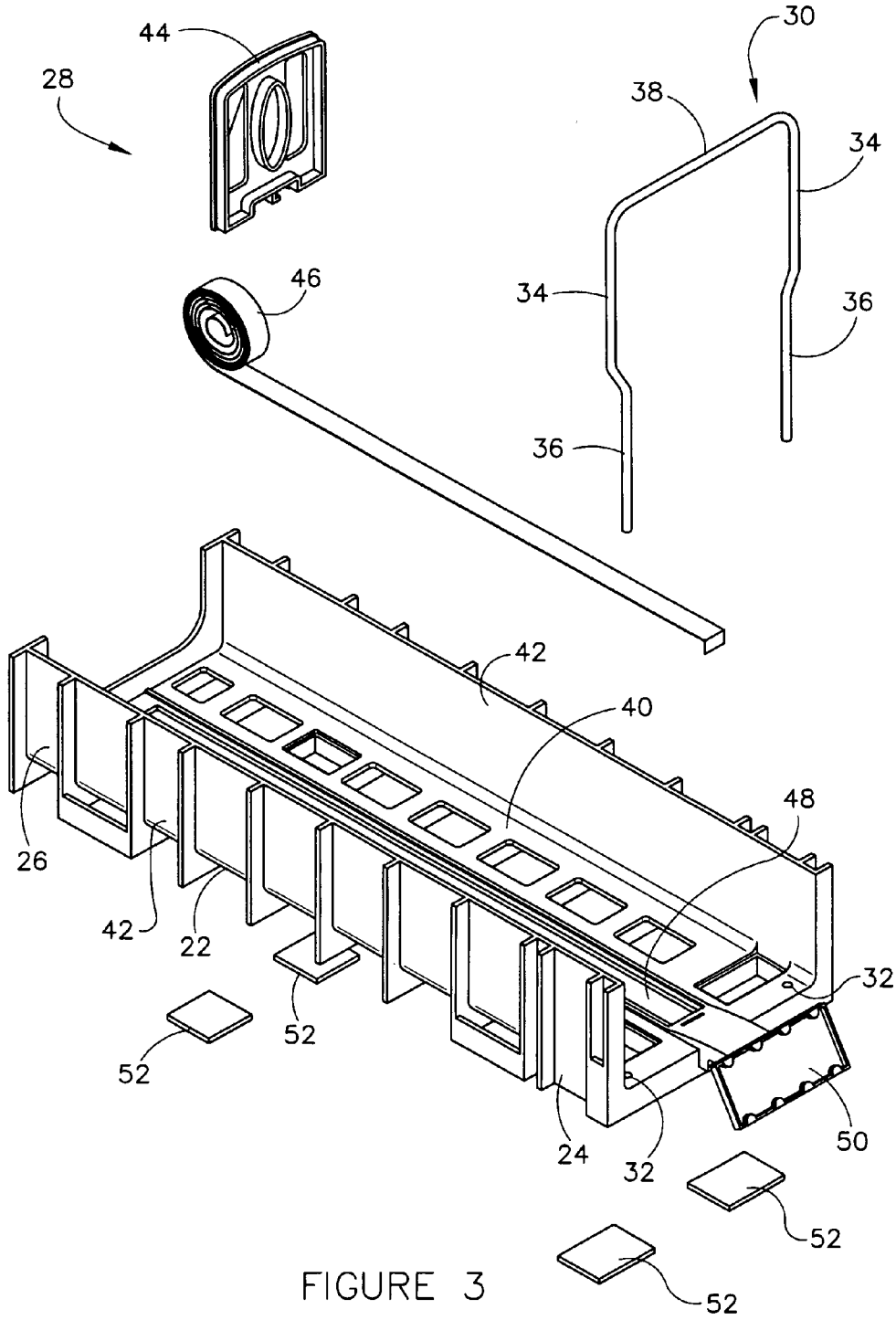
FIG. 3 is an exploded front perspective view of the merchandising system.
Figure 4:
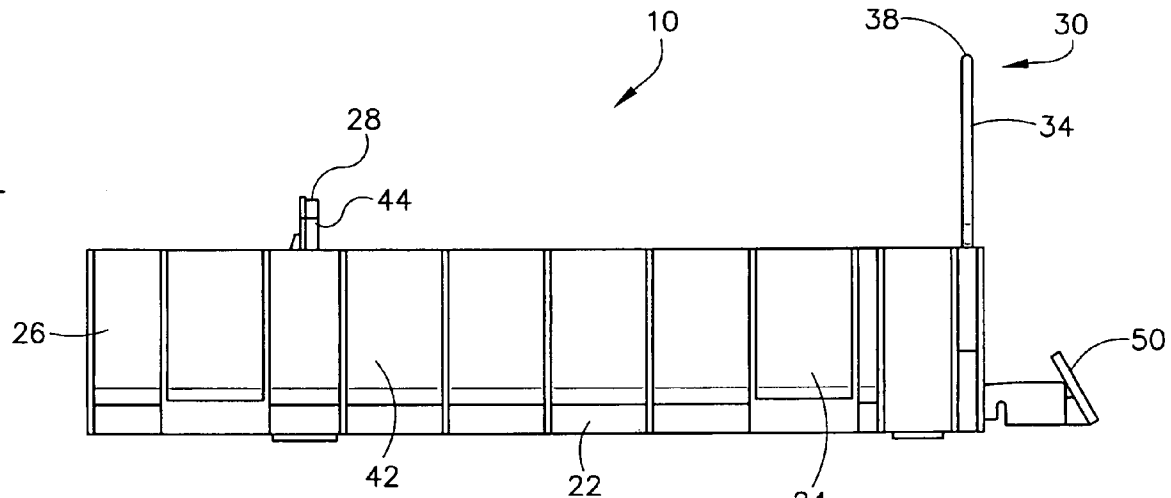
FIG. 4 is a side elevation view of the merchandising system.
Figure 5:
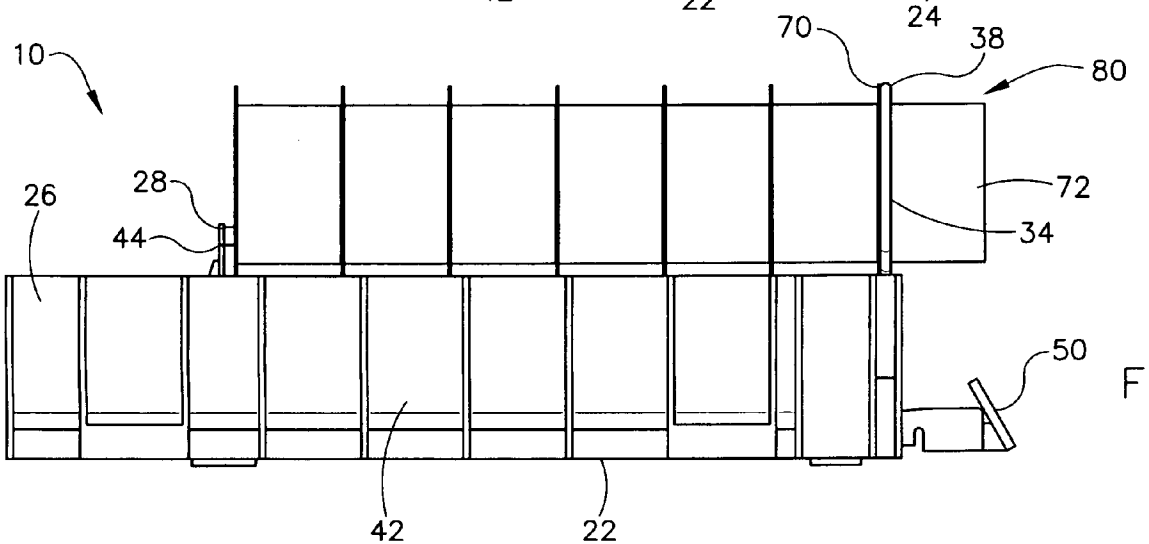
FIG. 5 is a side elevation view of the merchandising system containing product.
Figure 6:
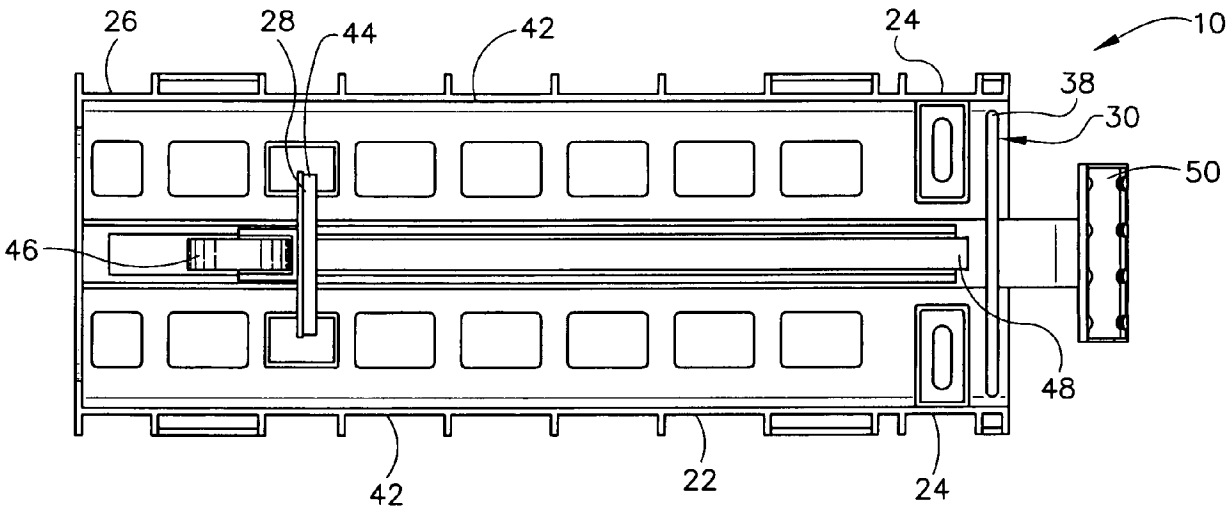
FIG. 6 is a top plan view of the merchandising system according to an exemplary embodiment.

According to an exemplary embodiment, a frame member or frame 30 is located near front end 24 of base 22. As shown in FIGS. 1 through 3, frame 30 has a substantially rectangular shape. Frame 30 comprises two side members 34 and an upper member 38. Frame 30 is releasably attached to base 22. Frame 30 provides one or more interfaces 36 configured to coact (e.g., attach, fasten, interface, couple, etc.) with base 22. According to one embodiment, the merchandising system includes a second frame member interchageable with a first frame member so that products having at least two configurations can be dispensed. According to a preferred embodiment as shown in FIG. 3, interfaces 36 are projections configured to coact with one or more apertures 32 provided in base 22. Interfaces 36 include projections which fit into apertures 32 and "snap" into place. Frame 30 is a removable and/or interchangeable component of system 10. According to alternative embodiments, different frames may be used (e.g., "snapped" into the system) depending on the different types of products being displayed. For example, the frame may be configured to match the profile, size, shape, overall design, etc. of any of a wide variety of articles and products. If the shape or configuration of a product or product container requires a more rectangular shaped frame, frame 130 from FIG. 8 may be used. If the shape or configuration of the product or product container requires a looped (or circular) frame, frames 230, 232 and 236 from FIGS. 9A, 9B, and/or 9D may be used. Frame 234 shown in FIG. 9C may be used when a top member is not required to retain product. The description of the various frames of FIGS. 9A through 9D are provided solely as examples and are not intended to be limiting in any way.

According to various alternative embodiments, the frame may provide for selective height or width adjustment. For example, the frame may be adjustable along its width in order to be used as an adjustable width system. According to another alternative embodiment, the upper member of the frame may be omitted. Two side members may be provided to support and/or retain product when the upper member is omitted. According to an alternative embodiment, the frame may be an integral piece formed with the system. According to other alternative embodiments, a wide variety of interfaces may couple the base and frame, including mechanical fasteners, adhesives, and the like. A first portion of the product may extend through the frame, while a second portion of the product may be retained or supported by the frame. According to one alternative embodiment, the frame may be provided below a portion of the product to support the product. According to an alternative embodiment, the support may be a hook, friction engagement, retainer, ring, etc. configured to hold the product when the product might otherwise not be supported. According to an alternative embodiment, the support may be one or more wedges configured such that the product will be dispensed between the wedges, yet the wedges will retain the product in an upright or vertical position. According to an alternative embodiment, the support may be a single member provided below a point on the product which would be adequately supported. For example, with a round lunchmeat container (having a cylindrical portion, and a flat panel back), such a point would be on a side of the cylindrical portion.

As shown in FIGS. 1 through 7, system 10 comprises an assembly 28 for advancing products and/or allowing products to advance from back end 26 to front end 24. Assembly 28 comprises a pusher plate 44 and a biasing element 46. Pusher plate 44 is configured to push product toward front end 24 by way of biasing element 46 (shown as a coil in FIG. 3). According to exemplary embodiments, the biasing element may comprise any number of devices including a spring, coil, band, or the like that are configured to apply a biasing force against the pusher plate toward the front end of the base. According to a preferred embodiment, pusher plate 44 is configured to move along a slot 48 (e.g., track, guide, or other guide means provided on the system). According to alternative embodiments, the slot may be provided in a variety of locations on the merchandising system (e.g., on the sidewalls).

As shown in FIGS. 1–7, system 10 includes a front panel 50 for displaying product information. Product information may be provided by placing an information containing article (e.g., label, card, etc.) in panel 50. As shown in FIGS. 8 through 12, label 132 is provided in panel 134. Label 132 contains information relating to the product contained in the system. The interchangeable configuration of the panel has the advantage of allowing relatively easy changing or updating of the label.

According to a preferred embodiment, the merchandising system may generally be made from extruded or injection molded plastic. However, a variety of plastics may be used in constructing the merchandising system. For example, the system may be constructed from high-impact plastics and the like. Using plastic offers several advantages including that the pieces are moldable in a variety of different colors, surface finishes, textures, etc. According to alternative embodiments, the tray systems may be constructed from a wide variety of materials including polymers, composites, metals, alloys, etc.

The pusher plate and frame may be constructed from injection molded plastic. A variety of plastics, polymers, and other materials including composites, metals, alloys, etc. may be used in constructing the components. According to a preferred embodiment, the frame is constructed from a wire material (e.g., metal, alloy, etc.).

As shown in the FIGURES, product may be merchandised in a base of a merchandising system. The product may be packages of food, meat, meat products having a round or rectangular portion surrounded by a web of material, or other shaped products which may pose challenges with regards to presentation or display of such products. As an example, products may need to be provided in a certain orientation or configuration to effectively be merchandised. Such product may be packages of round or rectangular lunchmeat which need to be merchandised in a vertical orientation. However, such products may not provide a base or surface on which they can be supported in that configuration. For example, the round or rectangular lunchmeat packages (in a vertical orientation) provide little support to securely hold or support itself. As a result, additional support from the merchandising system may be required.

As shown in FIG. 2, frame 30 provides additional support for products so they are merchandised in the necessary orientation. Product is urged toward the front of base 22 to partially extend through frame 30. A first portion 70 of the product is retained by frame 30 and/or the projections provided on frame 30. The pusher plate and biasing element help provide a holding force by pushing the first portion 70 of the product up against frame 30 and/or projections on frame 30. Product is supported by one or more members of frame 30, and/or one or more projections provided on frame 30. A second portion 72 (e.g., the bulk) of the product extends through frame 30, while first portion 70 of the packaging is retained by frame 30, against the force of the assemblies for advancing the products. Additionally, base 22 of frame 30 provide additional support for the product.

It is important to note that the construction and arrangement of the elements of the merchandising system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. It is important to note that any dimensions shown are dimensions of particularly preferred embodiments, and are not intended to be limited to those dimensions. Elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). It should be noted that the elements and/or assemblies of the system may be constructed from any of a wide variety of materials that provide sufficient strength or durability, in any of a wide variety of colors, textures and combinations. It should also be noted that the display system may be used in association with a rotating display, or alternatively other, fixed and non-movable displays or any of a wide variety of other surfaces in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A merchandising system for presenting and storing products provided in product cases, the system comprising:

a base having a front end and a back end, the base being configured to support the products;

a first frame having a first configuration;

a second frame having a second configuration different than the first configuration; and a pusher coupled to the base;

wherein the first frame and the second frame are interchangeably mountable to the front end of the base; and wherein the pusher is configured to advance products from the back end toward the front end.

2. The merchandising system of claim 1, wherein at least one of the first frame and the second frame comprises a top member and two side members.

3. The merchandising system of claim 2, wherein at least one of the two side members and the top member includes a curved portion.

4. The merchandising system of claim 1, wherein at least one of the first frame and the second frame comprises one continuous member that is generally curved along its length.

5. The merchandising system of claim 1, wherein at least one of the first frame and the second frame comprises a wire frame.

6. The merchandising system of claim 1, wherein the first frame is sized to accommodate products of a first shape and the second frame is sized to accommodate products of a second shape different than the first shape.

7. The merchandising system of claim 1, wherein the pusher comprises a pusher plate and a biasing element.

8. The merchandising system of claim 7, wherein the biasing element biases the pusher plate toward the front end of the base.

9. The merchandising system of claim 8 wherein the first frame and the second frame are configured to selectively retain products within the base against the bias provided by the biasing element.

10. The merchandising system of claim 7, wherein the pusher plate comprises a front face having at least one protrusion.

11. The merchandising system of claim 1, further comprising a front panel for displaying product information.

12. The merchandising system of claim 1, wherein the base further comprises a plurality of holes.

13. The merchandising system of claim 1, wherein the base further comprises a plurality of ribs.

14. A merchandising system for presenting and storing products, the merchandising system comprising:

a support assembly having a front end and a back end, the support assembly being configured to support the products;

a first frame having a first configuration; and a second frame having a second configuration different than the first configuration;

wherein the first frame and the second frame are configured to be interchangeably mounted to the front end of the support assembly for selectively dispensing the products from the merchandising system.

15. The merchandising system of claim 14, wherein at least one of the first frame and the second frame includes a curved portion.

16. The merchandising system of claim 15, wherein the first frame comprises a wire frame sized to accommodate products of a first shape and the second frame comprises a wire frame sized to accommodate products of a second shape different than the first shape.

17. The merchandising system of claim 14, wherein the support assembly further comprises a pusher for advancing products from the back end of the support assembly toward the front end of the support assembly.

18. The merchandising system of claim 17, wherein the pusher comprises a pusher plate and a biasing element, and wherein the biasing element biases the pusher toward the front end of the support assembly.

19. The merchandising system of claim 18, wherein the first frame and the second frame are configured to selectively retain products within the support assembly against the bias provided by the biasing element.

20. A merchandising system for dispensing products comprising:

a base configured to receive the products;

a pusher configured to provide a force on the products;

a first frame having a first portal through which the products may be dispensed; and a second frame having a second portal through which the products may be dispensed, the second portal having a different size than the first portal;

wherein the first frame and the second frame are interchangeably mountable to the base; and wherein the first frame and the second frame are configured to retain the products within the base.

* * * * *